US005678232A

United States Patent [19]

D'Muhala

[11] Patent Number: 5,678,232

[45] Date of Patent: *Oct. 14, 1997

[54] LEAD DECONTAMINATION METHOD

[75] Inventor: Thomas Francis D'Muhala, Raleigh, N.C.

[73] Assignee: Corpex Technologies, Inc., Morrisville, N.C.

[ * ] Notice: The term of this patent shall not extend beyond the expiration date of Pat. No. 5,591,270.

[21] Appl. No.: 695,330

[22] Filed: Jul. 31, 1996

Related U.S. Application Data

[63] Continuation of Ser. No. 508,382, Jul. 31, 1995, Pat. No. 5,591,270.

[51] Int. Cl.[6] ..... G21F 9/00

[52] U.S. Cl. ..... 588/1; 134/3; 134/22.19; 134/41; 376/309; 976/DIG. 376

[58] Field of Search ..... 588/1; 976/DIG. 376; 134/3, 22.19, 41; 376/309

[56] References Cited

U.S. PATENT DOCUMENTS

| | | | |
|---|---|---|---|
| 3,496,017 | 2/1970 | Weed | 134/2 |
| 3,803,295 | 4/1974 | Cathers et al. | 423/390 |
| 3,873,362 | 3/1975 | Mihram et al. | 134/3 |
| 3,970,239 | 7/1976 | Hill | 228/220 |
| 4,098,658 | 7/1978 | Ginatta | 204/114 |
| 4,162,229 | 7/1979 | Loewenschuss | 252/301.1 |
| 4,172,786 | 10/1979 | Humphrey et al. | 210/57 |
| 4,226,640 | 10/1980 | Bertholdt | 134/3 |
| 4,287,002 | 9/1981 | Torok | 134/3 |
| 4,437,999 | 3/1984 | Mayne | 210/748 |
| 4,540,443 | 9/1985 | Barber | 134/2 |
| 4,544,462 | 10/1985 | Furutani et al. | 204/129 |
| 4,693,833 | 9/1987 | Toshikuni et al. | 210/759 |
| 4,704,235 | 11/1987 | Arvesen | 252/626 |
| 4,762,693 | 8/1988 | Schimmel et al. | 423/321 |
| 4,836,900 | 6/1989 | Bellanger | 204/140 |
| 5,045,273 | 9/1991 | Gassen et al. | 376/309 |
| 5,089,217 | 2/1992 | Corpora et al. | 376/313 |
| 5,093,072 | 3/1992 | Guy et al. | 376/310 |
| 5,093,073 | 3/1992 | Schenker | 376/310 |
| 5,154,776 | 10/1992 | Bloch | 134/22.1 |
| 5,200,117 | 4/1993 | Morris et al. | 252/626 |
| 5,322,644 | 6/1994 | Dunn et al. | 252/626 |
| 5,358,549 | 10/1994 | Nagel et al. | 75/414 |
| 5,468,303 | 11/1995 | Thomas, Sr. | 134/3 |
| 5,489,735 | 2/1996 | D'Muhala et al. | 588/1 |
| 5,591,270 | 1/1997 | D'Muhala | 134/3 |

*Primary Examiner*—Ngoclan Mai
*Attorney, Agent, or Firm*—Bell, Seltzer, Park & Gibson

[57] ABSTRACT

The present invention provides a method of decontaminating an article containing lead contaminated with radioactive material. The method includes contacting the article containing lead contaminated with radioactive material with a decontamination composition comprising about 0.01 to 5 percent, by weight, of a reductant, about 0.01 to 5 percent, by weight, of a compound selected from the group consisting of citric acid, alkali metal and ammonium salts of citric acid and mixtures thereof; 1 to 15 percent, by weight, of a compound selected from the group consisting of polyaminocarboxylic acid, alkali metal and ammonium salts of polyaminocarboxylic acid and the combination of a polyaminocarboxylic acid and a neutralizing compound and mixtures thereof; 0 to 1 percent, by weight, of a nonionic surfactant; 0 to 1 percent, by weight, of a dispersant; and 0 to 1 percent, by weight, of a corrosion inhibitor, and the balance water or other aqueous liquid.

11 Claims, No Drawings

LEAD DECONTAMINATION METHOD

This application is a continuation of application Ser. No. 08/508,382, filed 31 Jul. 1995, now U.S. Pat. No. 5,591,270.

FIELD OF THE INVENTION

The present invention relates to lead decontamination, and more specifically decontamination of lead contaminated with man-made and naturally occurring radioactive materials.

BACKGROUND OF THE INVENTION

Lead in the form of bricks, shot, wool or sheets is often used as shielding in nuclear power plants and reactors. During the course of operation of the plant and reactor there can be continuous buildup of radioactivity on shielding. Of particular concern is the generation of an oxide layer (e.g., lead oxide) due to the oxidation of lead. This oxide layer can become contaminated with radioactive material during maintenance or an accident in the reactor system. Over an extended period of operation, the level of radioactivity can increase to the point where the exposure level of workers can reach potentially hazardous levels.

Various methods of decontamination of contaminated surfaces have been proposed. In general, various methods and compositions have been suggested based on aqueous solutions of mineral and organic acids. One common method is the two stage alkaline permanganate ammonium citrate ("APAC") method. (See, for example, U.S. Pat. No. 3,873,362 to Mihram et al.) This method, however, has the disadvantage of adversely affecting the base metal.

A variation of this technique is proposed in U.S. Pat. No. 4,226,640 to Bertholdt. The method proposed therein comprises pretreating with alkaline permanganate, rinsing with demineralized water, treating with a citrate-oxalate solution, rinsing with demineralized water, and post-treating with an acidified hydrogen peroxide solution containing suspended inert particles. This method requires strong acids and is conducted at elevated temperatures, namely, 85° C. to 125° C.

Another technique is proposed in U.S. Pat. No. 4,704,235 to Arvesen wherein an oxidizing agent is water-based and comprises cerium nitrate, chromic acid and ozone. This technique requires a strong and somewhat exotic nitrate. Other exemplary techniques, are proposed in U.S. Pat. No. 4,287,002 to Torok, U.S. Pat. No. 4,693,833 to Toshikuni et al., U.S. Pat. No. 5,093,073 to Schenker and U.S. Pat. No. 5,322,644 to Dunn et al.

There, however, continues to be a need for removing radioactive materials from lead, and more particularly a method for doing so without requiring strong acids or elevated temperatures or both.

SUMMARY OF THE INVENTION

To this end, it is an object of the present invention to provide a method of decontaminating articles containing lead which can be conducted at room temperature. It is another object to provide a method which obviates the need for using potentially hazardous materials such as strong acids and powerful oxidants in the decontamination process. A feature of the present invention is that the practice of the method thereof does not adversely affect the lead.

The method of the present invention comprises contacting, preferably at room temperature, the article containing lead contaminated with radioactive material with a decontamination composition comprising about 0.01 to 5 percent, by weight, of a reductant, about 0.01 to 5 percent, by weight, of a compound selected from the group consisting of citric acid, alkali metal and ammonium salts of citric acid and mixtures thereof; 1 to 15 percent, by weight, of a compound selected from the group consisting of polyaminocarboxylic acid, alkali metal and ammonium salts of polyaminocarboxylic acid and the combination of a polyaminocarboxylic acid and a neutralizing compound and mixtures thereof; 0 to 1 percent, by weight, of a nonionic surfactant; 0 to 1 percent, by weight, of a dispersant; and 0 to 1 percent, by weight, of a corrosion inhibitor, and the balance water or other aqueous liquid. Suitable reductants or reducing agents include ascorbic acid, hydroquinone, and various amines such as phenylenediamine and hydroxyamine sulfate.

DETAILED DESCRIPTION OF THE INVENTION

The present invention will now be described more fully hereinafter. This invention may, however, be embodied in many different forms and should not be construed as limited to the embodiment set forth herein; rather, this embodiment is provided so that this disclosure will be thorough and complete, and will fully convey the scope of the invention to those skilled in the art.

As summarized above, the method comprises contacting the article containing lead contaminated with radioactive material with a decontamination composition comprising about 0.01 to 5 percent, by weight, of a reductant, about 0.01 to 5 percent; by weight, of a compound selected from the group consisting of citric acid, alkali metal and ammonium salts of citric acid and mixtures thereof; 1 to 15 percent, by weight, of a compound selected from the group consisting of polyaminocarboxylic acid, alkali metal and ammonium salts of polyaminocarboxylic acid and the combination of a polyaminocarboxylic acid and a neutralizing compound and mixtures thereof; 0 to 1 percent, by weight, of a nonionic surfactant; 0 to 1 percent, by weight, of a dispersant; and 0 to 1 percent, by weight, of a corrosion inhibitor, and the balance wat&r (preferably dionized) or other aqueous liquid. Typically, the contacting is conducted at room temperature and a pH of from 2 to 9 with a neutral pH preferred. Any conventional technique can be employed to contact the composition with the article containing lead. Contacting of the object may be accomplished by spraying, immersing, showering, etc. with or without agitation, turbulence or the like. After contacting, the article is preferably subjected to a water rinse.

Reductants include ascorbic acid, hydroquinone, and various amines (e.g., phenyle/nediamine and hydroxyamine sulfate).

The alkali metal and ammonium salts of the citric acid can include mono- and disubstituted salts. A particularly preferred ammonium salt of citric acid is ammonium citrate.

Suitable polyaminocarboxylic acids include ethylenediaminetetraacetic acid, diethylenetriaminepentaaceticacid, triethylenetetraaminehexaacetic acid, N-2-hydroxyethylethylenediaminetriacetic acid, propylene-1,2-diaminetetraacetic acid, propylene-1,3-diaminetetraacetic acid, nitrilotriacetic acid, the ammonium and alkali metal salts of said acids, and the combination of the polyaminocarboxylic acids with a neutralizing compound, and mixtures thereof. The alkali metal and ammonium salts can include mono- and disubstituted salts. A particularly preferred polyaminocarboxylic acid is ethylenediaminetetraacetic acid. A suitable neutralizing compound is hydrazine.

Suitable nonionic surfactants include Triton X-100, a octylphenoxy-polyethoxyethanol with 9 to 10 moles of ethylene oxide surfactant, available from Union Carbide, Danbury, Connecticut, and Pluronic L-101, a polyoxyethylene-polyoxypropylene block polymer surfactant, available from BASF-Wyandotte, Wyandotte, Michigan. A suitable dispersant for organic solids is Tamol SN, a sodium salt napthalenesulfonic acid, available from Rohm & Haas, Philadelphia, Pennsylvania. A suitable dispersant for inorganic solids is sodium lignosulfonate. A suitable corrosion inhibitor is Rodine 95, which includes thiourea, formaldehyde, o-toluidine and substituted triazine hydrochloric acid, available from Parker + Amchem, Madison Heights, Michigan.

The radioactive material and minor amounts of dissolved lead can be recovered from solution using known techniques such as by ion exchange, selective adsorption, reagent destruction, filtration, precipitation or a combination of these techniques. The recovered radioactive material can be compacted and disposed of, for example, using conventional burial techniques. The lead thusly decontaminated can be reused or released to the public for use in another form such as in batteries or the like.

EXAMPLE 1

The following decontamination composition is blended together:

| Component | Amount |
|---|---|
| Diammonium/EDTA | 160 g |
| Diammonium Citrate | 15 g |
| Ascorbic Acid | 15 g |
| Triton X-100 | 3 mL |
| Deionized Water | 1.2 L |

A lead brick, from the shield plug assembly that had been exposed to a sodium fire during a reactor melt down, is surveyed using a Ludlum Model 44-9 Pancake Probe with a Model 2 Survey Meter to determine the initial radiological contamination levels on it. The lead brick has an average contamination level of about 40,000 dpm/100 $cm^2$. The brick is then immersed in the decontamination solution at room temperature. All sides of the brick except the surface which had been directly exposed to the fire became visually clean (i.e., metallic bright) within 15 minutes. The side that had been exposed to the fire has an orange-red deposit remaining on it. The brick is left in the solution for a total of 60 minutes. Over this period, the orange-red deposit dissolved. The brick is removed from the decontamination solution, rinsed, and blotted dry. The dried brick had an activity of less than 100 dpm/100 $cm^2$, which is the minimum detectable activity for the instrument used.

EXAMPLE 2

A small vial of lead shot about 75 $cm^3$ contained in a vial capable of holding 200 $cm^3$ of this material is decontaminated. The diameter of this shat is about 1/16 of an inch. The instrument had a count rate of about 120,000 cpm at the top of the vial. This geometry is not standard, but the cpm indicates significant radiological contamination. Next about 1/3 of the shot is transferred to a beaker, a sufficient amount of the decontamination composition of Example 1 at room temperature is added to cover the shot with several inches of the composition. The beaker was slowly turned causing the shot to tumble in the decontamination composition for about 20 minutes. After this period, the lead shot was rinsed and blotted dry. The lead shot is then surveyed by piling the shot in various configurations under the detector probe. The detector indicated background or minimal detectable activity.

That which is claimed is:

1. A method of decontaminating articles containing lead contaminated with naturally occurring and man-made radioactive materials, the method comprising contacting the article at room temperature with a decontamination composition comprising about 0.01 to 5 percent, by weight, of a reductant, about 0.01 to 5 percent, by weight, of a compound selected from the group consisting of citric acid, alkali metal and ammonium salts of citric acid and mixtures thereof, 1 to 15 percent, by weight, of a compound selected from the group consisting of polyaminocarboxylic acid, alkali metal and ammonium salts of polyaminocarboxylic acid and the combination of a polyaminocarboxylic acid and a neutralizing compound and mixtures thereof; 0 to 1 percent, by weight, of a nonionic surfactant; 0 to 1 percent by weight, of a dispersant; and 0 to 1 percent, by weight, of a corrosion inhibitor, and the balance an aqueous liquid.

2. The method according to claim 1 wherein the reductant is selected from the group consisting of ascorbic acid, hydroquinone, phenylenediamine and hydroxyamine sulfate.

3. The method according to claim 1 wherein the polyaminocarboxylic acid is selected from the group consisting of ethylenediaminetetraacetic acid, diethylenetriaminepentaacetic acid, triethylenetetraaminehexaacetic acid, N-2-hydroxyethylethylenediaminetriacetic acid, propylene-1,2-diaminetetraacetic acid, propylene-1,3-diaminetetraacetic acid, nitrilotriacetic acid, the ammonium and alkali metal salts of said acids, and the combination of said acids with neutralizing compounds and mixtures thereof.

4. The method according to claim 1 wherein the polyaminocarboxylic acid is ethylenediaminetetra- acetic acid.

5. The method according to claim 1 wherein the citric acid is diammonium citrate.

6. A method of decontaminating articles containing lead contaminated with naturally occurring and man-made radioactive materials, the method comprising contacting the article at room temperature with a decontamination composition comprising about 0.01 to 5 percent, by weight, of ascorbic acid, about 0.01 to 5 percent, by weight, of a compound selected from the group consisting of citric acid, alkali metal and ammonium salts of citric acid and mixtures thereof; 1 to 15 percent, by weight, of a compound selected from the group consisting of polyaminocarboxylic acid, alkali metal and ammonium salts of polyaminocarboxylic acid and the combination of a polyaminocarboxylic acid and a neutralizing compound and mixtures thereof; 0 to 1 percent, by weight, of a nonionic surfactant; 0 to 1 percent, by weight, of a dispersant; and 0 to 1 percent, by weight, of a corrosion inhibitor, and the balance an aqueous liquid.

7. The method according to claim 6 wherein the polyaminocarboxylic acid is selected from the group consisting of ethylenediaminetetraacetic acid, diethylenetriaminepentaacetic acid, triethylenetetraaminehexaacetic acid, N-2-hydroxyethylethylenediaminetriacetic acid, propylene-1,2-diaminetetraacetic acid, propylene-1,3-diaminetetraacetic acid, nitrilotriacetic acid, the ammonium and alkali metal salts of said acids, and the combination of said acids with neutralizing compounds and mixtures thereof.

8. The method according to claim 6 wherein the polyaminocarboxylic acid is ethylenediaminetetraacetic acid.

9. The method according to claim 6 wherein the citric acid is diammonium citrate.

10. The method according to claim 1, wherein the aqueous liquid is water.

11. The method according to claim 6, wherein the aqueous liquid is water.

* * * * *